United States Patent [19]

Gorecki

[11] Patent Number: 4,949,925

[45] Date of Patent: Aug. 21, 1990

[54] LADDER CADDY

[76] Inventor: Dennis E. Gorecki, 5825 Melanite, Houston, Tex. 77053

[21] Appl. No.: 379,612

[22] Filed: Jul. 13, 1989

[51] Int. Cl.[5] ..... E06C 7/14

[52] U.S. Cl. ..... 248/238; 182/129

[58] Field of Search ..... 182/129, 120, 121; 248/210, 211, 238

[56] References Cited

U.S. PATENT DOCUMENTS

| | | | |
|---|---|---|---|
| 3,707,242 | 12/1972 | Golden | 248/210 |
| 4,222,541 | 9/1980 | Cillis | 248/210 |
| 4,445,659 | 5/1984 | LaChance | 248/210 |
| 4,494,627 | 1/1985 | Arent | 182/129 |
| 4,662,594 | 5/1987 | Dubis | 248/238 |
| 4,776,550 | 10/1988 | Storey | 248/210 |

*Primary Examiner*—Reinaldo P. Machado
*Attorney, Agent, or Firm*—William E. Shull

[57] ABSTRACT

An adjustable, portable utility shelf includes a main tray having a flat work surface and raised sides. Slide guides are disposed along the sides of the main tray, and comprise channels for receiving correlatively shaped and inter-engageable channels on removable auxiliary trays. A clamp assembly includes a base plate rotatably attached to the rear wall of the main tray at its center, and is releasably attachable to a side rail of a ladder. The base plate has a plurality of locating holes in it forming an arc with respect to the rotatable connection between the base plate and the rear wall of the main tray. A tray support bracket attached to the center of the underside of the main tray includes a strut having a locating pin protruding therefrom. The locating pin can be placed in any one of the locating holes, fixing the tray at a selected angular orientation with respect to the base plate, and is positively retained in the selected locating hole by the weight of the tray and its contents. An insulated electrical receptacle can be mounted in the main tray.

7 Claims, 4 Drawing Sheets

LADDER CADDY

BACKGROUND OF THE INVENTION

The present invention relates generally to portable, adjustable utility shelves. More particularly, the present invention is an adjustable, multi-purpose utility shelf designed to be attached to the side of an extension ladder or the like for providing a painter, handyman, or other workman with an easily accessible, convenient work surface. A modular utility tray system is used for holding power tools, hand tools, nails, nuts and bolts, food and/or drinks, trash, or any of a virtually unlimited variety of other items.

In the past, persons who work from extension ladders have had difficulty storing and/or handling all of the items they required for completing the tasks they set out to accomplish. Such persons often were inconvenienced in having to make multiple trips up and down the extension ladder to retrieve a particular tool or the like, or to replace one tool with another, because of the lack of convenient storage for such tools up on the ladder, at the workplace. Furthermore, when the ladder is placed at an angle to the wall or other object for support, it is desirable to be able to adjust the work surface to be substantially horizontal or level, regardless of the particular angle between the ladder and the wall. Some fixed-position extension ladder shelves have been used in the past, but they have not been horizontally adjustable. Another problem is presented to the workman using an electric power tool from an extension ladder. Frequently, an extension cord is required to supply the necessary power, and often the workman must support not only the weight of the tool, but also the weight of the cord. This can be very tiring, awkward, or even dangerous for the workman.

The present invention is designed to overcome all of the problems described above with a simple, easy-to-manufacture, modular utility tray system that is ideal for anyone having to work from an extension ladder.

SUMMARY OF THE INVENTION

The present invention includes a main tray having a flat work surface and raised sides. Removable tray guides or slide guides are disposed along the sides of the main tray, and comprise channels for receiving correlatively shaped and inter-engageable channels on removable tool trays. A clamp includes a base plate, two threaded studs substantially perpendicularly attached to the base plate, a clamping bar, and a pair of wing nuts. The clamp is rotatably connected to the rear raised wall of the main tray by a machine screw. The clamping bar has an inverted U-shaped slot in one end, and a hole in the other end. One of the studs is received in the hole in the clamping bar, the hole being larger in diameter than the stud to allow the clamping bar to rotate easily about it. The other stud is insertable into the U-shaped slot. When the bar is rotated so that the U-shaped slot is sufficiently removed from its stud, the clamp is placed on the side rail of the extension ladder at the desired location so that the rail is disposed between the studs. The clamping bar is then swung down, so that the second stud enters the U-shaped slot. The wing nuts are then tightened on the studs, securing the clamp to the ladder rail.

The base plate is provided with a plurality of holes for receiving a locating pin protruding from a tray support on the bottom of the main tray. The tray is substantially leveled by placing the locating pin in the desired hole in the base plate. The locating pin is positively retained in the selected hole by the weight of the tray, and its contents.

An insulated 3-way electrical outlet can be built into the surface of the main tray as an option, for facilitating the use of power tools from the extension ladder.

Any of a variety of removable tool trays can be used with the main tray, in any of a variety of combinations.

BRIEF DESCRIPTION OF THE DRAWINGS

The above-desired features and advantages of the present invention will be apparent from the following detailed description, read conjunction with reference to the following drawings wherein.

DETAILED DESCRIPTION OF THE PREFERRED EMBODIMENT OF THE INVENTION

Figure 1A:
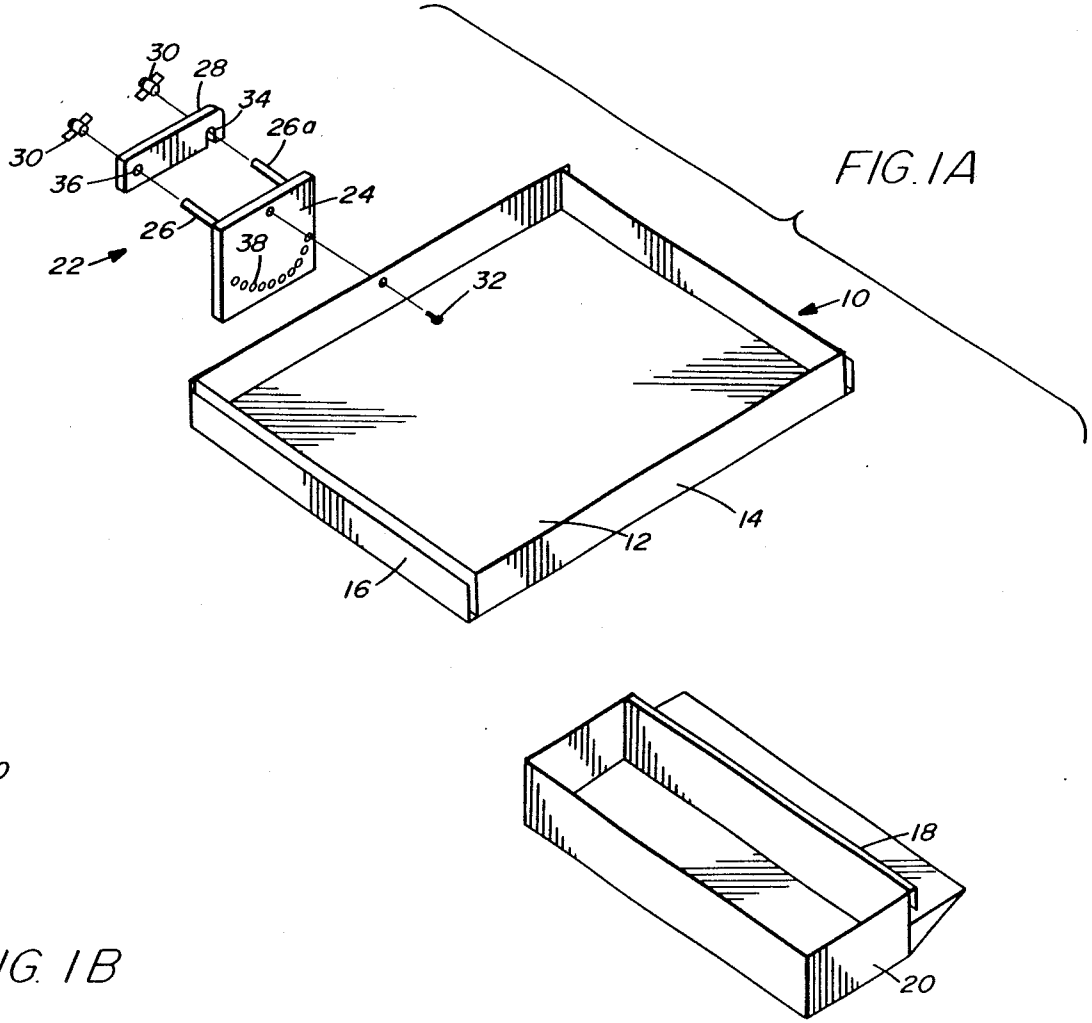
FIG. 1A is an exploded, top front isometric view of the main tray, base plate, and clamping bar, along with a representative tool tray, of the present invention.
Figure 1B:
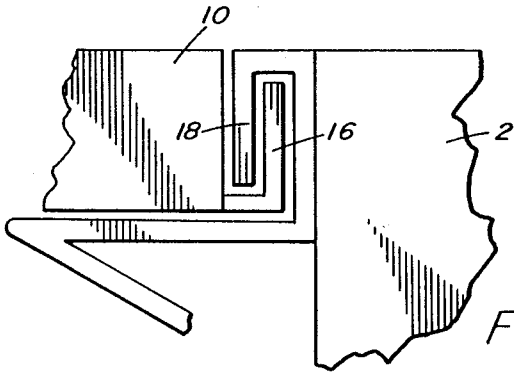
FIG. 1B is a fragmentary view of a removable tool tray attached to the main tray with the slide guides of the present invention.

As shown in FIGS. 1A and 1B, the present invention comprises a main tray 10 having a flat work surface 12 and raised sides 14. Removable tray guides or slide guides 16 are disposed along the sides of main tray 10, and comprise channels for receiving correlatively shaped and inter-engageable channels 18 on removable, auxiliary tool trays, e.g., tray 20. A clamp assembly 22 includes a base plate 24, threaded studs 26, **26*a* substantially perpendicularly attached to the base plate, a clamping bar 28, and wing nuts 30; clamp assembly 22 is rotatably connected to main tray 10 via a machine screw 32 disposed in a hole substantially in the center of the rear wall of the main tray 10 and threaded into a bore in the upper portion of the base plate substantially in the center thereof. Clamping bar 28 has an inverted U-shaped slot 34 in one end, and a hole 36 in the other end. Hole 36 receives stud 26, the hole being larger than the stud to allow bar 28 to rotate easily about it. The U-shaped slot 34 receives the second stud 26*a* therewithin. When bar 28 is rotated so that slot 34 is sufficiently removed from its stud 26*a*, clamp 22 is placed on the side rail of the extension ladder at the desired location so that the rail is disposed between the studs. Bar 28 is then swung down, so that stud 26*a* enters slot 34. The wing nuts 30** are then tightened on the studs, securing the clamp assembly to the ladder rail.

In order to level main tray 10 when the ladder is placed against a wall or other surface, base plate 24 is provided with a plurality of holes 38 disposed in an arc below a threaded bore 46 (see FIG. 3) for receiving a locating pin 40 protruding from a tray support 42 disposed substantially in the center on the bottom of main tray 10 (see FIG. 2). The tray support 42 includes a downwardly extending strut portion 43 disposed below the hole 45 through which screw 32 extends. When the front edge of main tray 10 is grasped and lifted outwardly and upwardly, locating pin 40 is removed from one of holes 38 and tray 10 can be rotated around screw 32 until pin 40 is aligned with another of holes 38, i.e., the hole which most nearly results in leveling of the tray. The weight of the tray itself, assisted by the weight of the objects disposed on it, positively keeps pin 40 in the selected hole 38.

Figure 3:
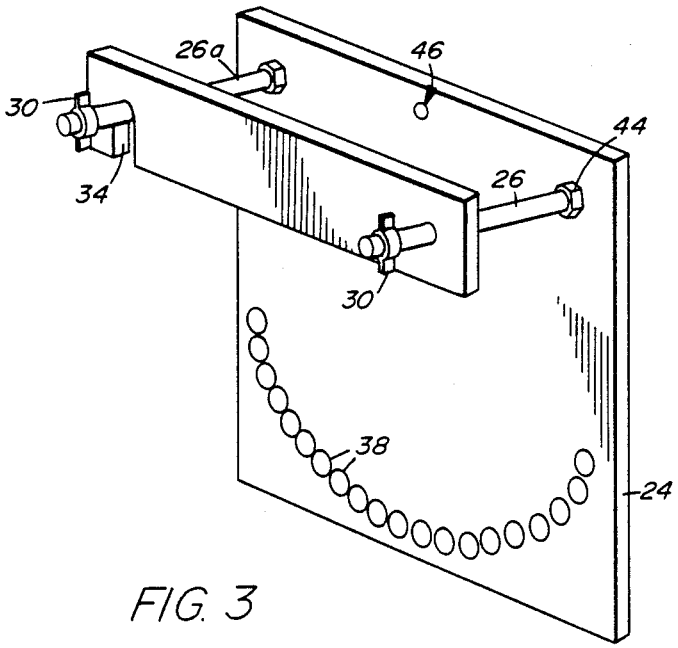
FIG. 3 is an isometric view of the clamp assembly of the present invention.

As shown in FIG. 3, studs 26, 26*a* may be countersunk bolts retained on base plate 24 by nuts 44. Threaded bore 46 in base plate 24 receives machine screw 32.

Figure 2:
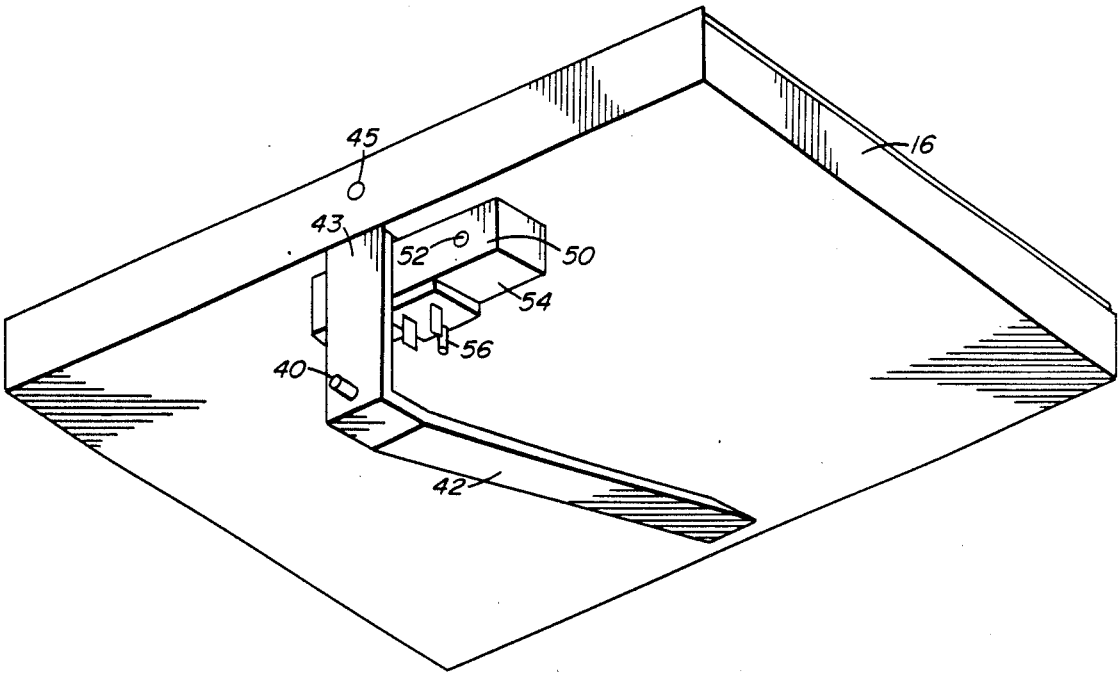
FIG. 2 is a bottom rear isometric view of the main tray of the present invention.
Figure 4:
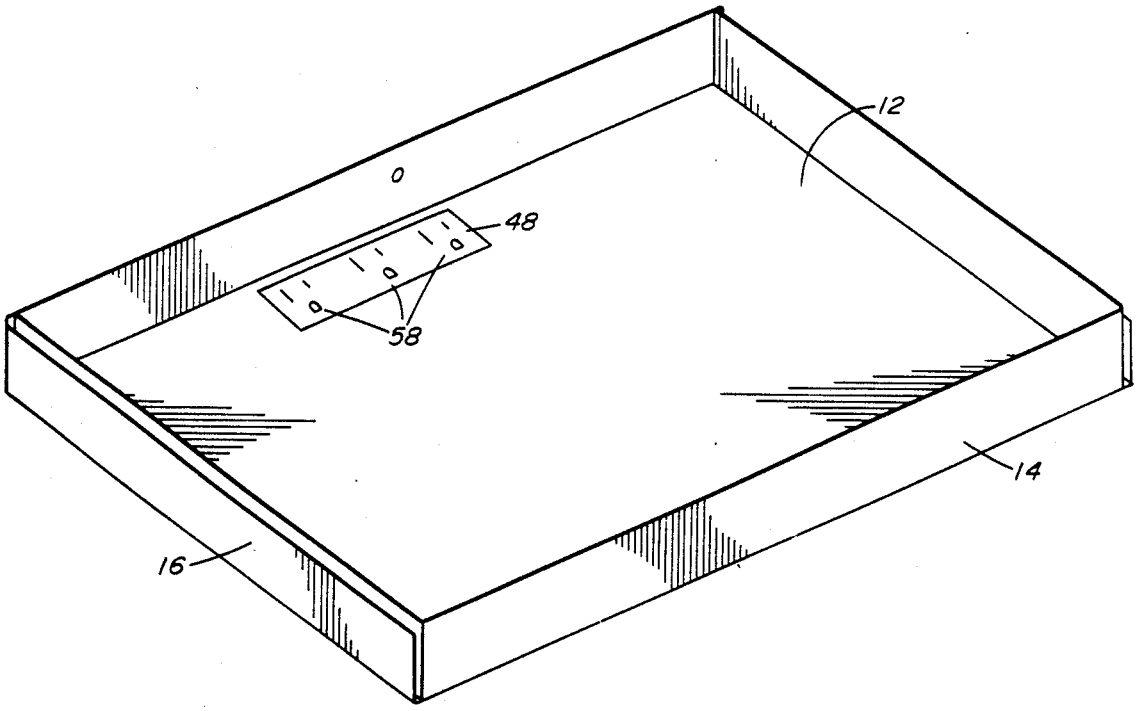
FIG. 4 is a top front isometric view of the main tray of the present invention showing a 3-way electrical outlet built into the surface of the main tray.

In order to facilitate use of electric power tools on the extension ladder, main tray 10 may be provided with a 3-way outlet 48 built into surface 12 (see FIGS. 2 and 4). Outlet 48 is secured, as by screws 52, to a flange 50 mounted on the underside of tray 10. Outlet 48 has a primarily rectangular-shaped rubber body 54, downwardly extending prongs 56 on its lower surface, and receptacles 58 on its upper surface. When an extension cord is connected to prongs 56, as many as three power tools (or a radio or the like) can be plugged into receptacles 58. The entire weight of the extension cord is borne by the tray 10 and the ladder, and not by the operator. The operator thus has greater mobility and maneuverability to use the tools, with less fatigue and increased safety since the extension cord is not being carried by him or in his way. The outlet 48 is insulated by rubber body 54 from the main tray 10 so as not to subject the operator to risk of shock through the tray or the ladder from faulty electrical cords or the like.

Figure 5:
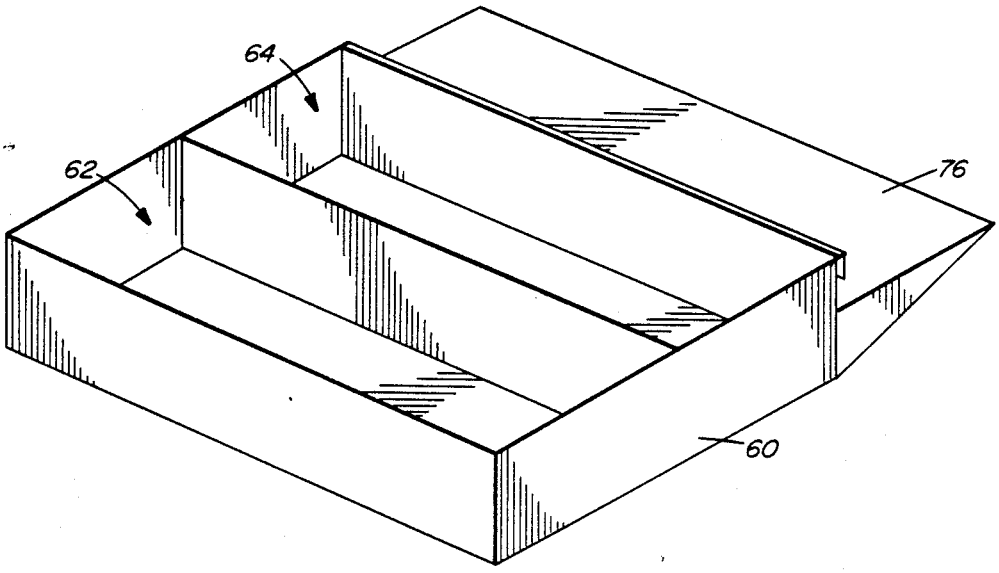
FIG. 5 a top front isometric view of a removable double tool tray of the present invention.
Figure 7:
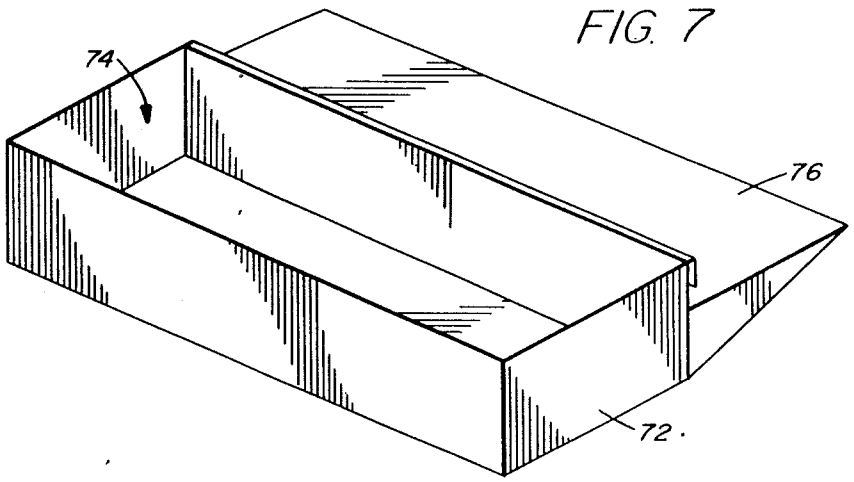
FIG. 7 is a top front isometric view of a removable single tool tray of the present invention.
Figure 6:
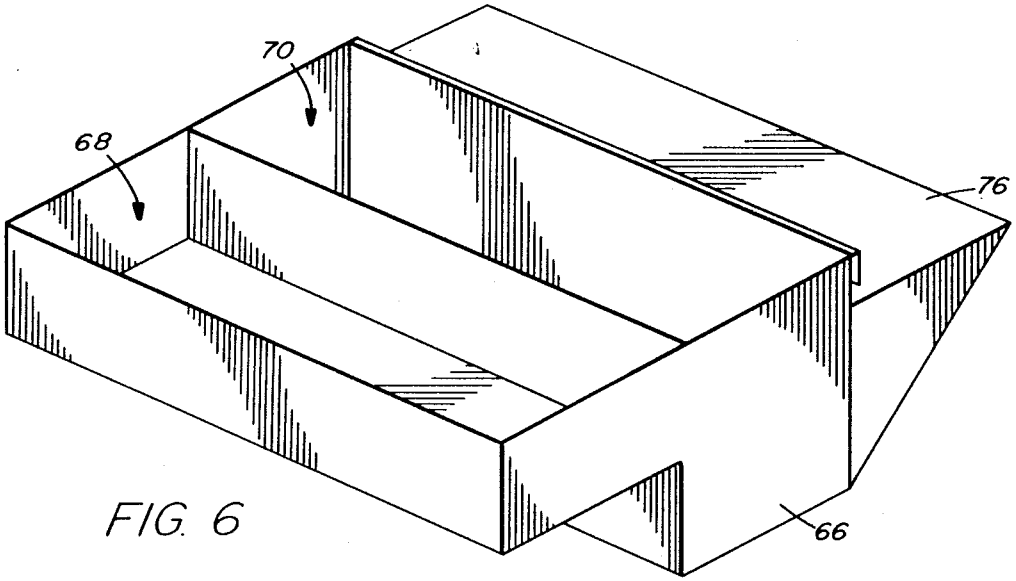
FIG. 6 is a top front isometric view of a removable trash and tool tray of the present invention.

As shown in FIGS. 5, 6, and 7, any of a variety of removable auxiliary tool trays can be used with main tray 10, in any of a variety of combinations. For example, a double tool tray 60 having two tool compartments 62, 64 (FIG. 5) is one configuration of removable tray which can be used. Another is a combination trash and tool tray 66 having one tool compartment 68 and one deeper trash compartment (which may be used for other purposes, of course, such as holding food, drinks, or other items) 70 (FIG. 6). Another is a simple tool tray 72 having only a single compartment 74 (FIG. 7). Other configurations of trays could be used. Each tray has a tray support 76 which extends under the main tray 10 when the removable tray is mounted on the main tray. The tray support 76 prevents the removable trays from rotating about an axis through the slide guides. That is, the tray supports 76 prevent collapse of the trays under load when in use. Any one of these removable trays can be used alone, in combination with another type of tray, or with a tray of the same type, depending on the desires of the operator. Of course, main tray 10 can be used alone, without any removable trays attached to it, if desired.

Main tray 10 and removable trays 60, 66, and 72 may be made of sheet metal, heavy duty plastic, or other suitable strong, tough, and lightweight material. Clamp 22 is preferably made of metal, such as galvanized steel to inhibit rusting.

While preferred embodiments of the invention have been shown and described, many modifications thereof may be made by those skilled in the art without departing from the spirit of the invention. Therefore, the scope of the invention should be determined in accordance with the following claims.

I claim:

1. An adjustable utility shelf for attachment to a side rail of a ladder, comprising:

a tray having an upper support surface;

clamp means rotatably connected to said tray for permitting said tray to pivot about said clamp means, said clamp means including means for releasably attaching said clamp means to the said rail of the ladder; and angular locating means disposed on and interconnecting said tray and said clamp means for positively retaining said tray in a selected angular position with respect to said clamp means, wherein said tray is a main tray and further including an auxiliary tray, said main tray including slide guide means disposed thereon for receiving correlatively shaped, interengageable slide guide means disposed on said auxiliary tray for removably attaching said auxiliary tray to said main tray, and wherein said main tray and said auxiliary tray each includes a raised side wall and said slide guide means on said main tray and said auxiliary tray each include an elongate U-shaped channel disposed along the raised side wall of the respective tray, one of said channels opening upwardly and the other of said channels opening downwardly.

2. An adjustable utility shelf according to claim 1, wherein the one of said channels which opens upwardly is attached near the bottom edge of the raised wall on which it is disposed, and the other of said channels which opens downwardly is attached near the top edge of the raised wall on which it is disposed.

3. An adjustable utility shelf according to claim 1, wherein said auxiliary tray includes support means disposed thereon and extending under said support surface of said main tray when said auxiliary tray is attached to said main tray, for supporting said auxiliary tray against rotation about an axis through said elongate channels.

4. An adjustable utility shelf for attachment to a side rail of a ladder, comprising:

a tray having an upper support surface;

clamp means rotatably connected to said tray for permitting said tray to pivot about said clamp means, said clamp means including means for releasably attaching said clamp means to the side rail of the ladder; and angular locating means disposed on and interconnecting said tray and said clamp means for positively retaining said tray in a selected angular position with respect to said clamp means, wherein said tray includes a raised rear wall, and wherein said clamp means includes a base plate, a hole near its upper edge for securing a connector disposed in an opposed hole through said rear wall, said connector permitting rotation of said tray with respect to said base plate about an axis through said connector, a pair of studs attached to the rear face of said base plate and projecting substantially perpendicular thereto, and a clamping bar having a hole in one end and a U-shaped slot in the other end, said hole in said clamping bar rotatably receiving one of said studs therewithin and the other of said studs being insertable into the opening of said slot, the side rail of the ladder being insertable between said studs, said clamping bar being rotatable on said one of said studs to capture the other of said studs in said slot with the side rail of the ladder sandwiched between the base plate and the clamping bar, and means for compressing said clamping bar toward said base plate for preventing removal of said clamping bar from said other of said studs.

5. An adjustable utility shelf according to claim 4, wherein said angular locating means includes a plurality of locating holes in said base plate below and forming an arc with respect to the rotatable connection between said base plate and said rear wall of said tray, and a tray support bracket disposed substantially in the center on the underside of said support surface, said tray support bracket including a downwardly extending strut below said opposed hole in said rear wall of said tray and a locating pin projecting rearwardly of said strut, said locating pin being alternately receivable in said locating holes.

6. An adjustable utility shelf according to claim 5, wherein the weight of said tray acts to retain said locating pin in the selected one of said locating holes.

7. An adjustable utility shelf according to claim 6, wherein said locating pin is removable from the first selected one of said locating holes to a second selected one of said locating holes when the front edge of said tray is rotated upwardly.

* * * * *